US009492038B2

(12) United States Patent
Taingtae et al.

(10) Patent No.: US 9,492,038 B2
(45) Date of Patent: Nov. 15, 2016

(54) SHOWER DOOR SEAL SYSTEM

(71) Applicant: Kohler Co., Kohler, WI (US)

(72) Inventors: Weerasak Taingtae, Sheboygan, WI (US); Roque M. Corpuz, Jr., Sheboygan, WI (US); Matthew Joseph Ball, Sheboygan Falls, WI (US); Peter W. Swart, Oostburg, WI (US)

(73) Assignee: KOHLER CO., Kohler, WI (US)

( * ) Notice: Subject to any disclaimer, the term of this patent is extended or adjusted under 35 U.S.C. 154(b) by 274 days.

(21) Appl. No.: 14/209,541

(22) Filed: Mar. 13, 2014

(65) Prior Publication Data

US 2014/0259367 A1 Sep. 18, 2014

Related U.S. Application Data

(60) Provisional application No. 61/793,434, filed on Mar. 15, 2013.

(51) Int. Cl.
*A47K 3/00* (2006.01)
*A47K 3/34* (2006.01)
*A47K 3/30* (2006.01)

(52) U.S. Cl.
CPC ..... *A47K 3/34* (2013.01); *A47K 2003/305* (2013.01)

(58) Field of Classification Search
CPC ..... A47K 3/34
USPC ..... 4/596–614
See application file for complete search history.

(56) References Cited

U.S. PATENT DOCUMENTS 2,802,247 A 8/1957 Anderson
2,848,767 A 8/1958 Tompson
3,118,193 A 1/1964 Oksland
3,380,193 A 4/1968 Hill
4,283,884 A 8/1981 Dumenil et al.
4,425,738 A 1/1984 Christensen
4,754,573 A * 7/1988 van Rooij ..... E06B 3/4654 49/370

(Continued)

FOREIGN PATENT DOCUMENTS

CN 2263188 9/1997
CN 2565930 8/2003

(Continued)

OTHER PUBLICATIONS

First Office Action received for Chinese Application No. CN201410095601.5 issued Aug. 17, 2015.

(Continued)

*Primary Examiner* — Lori Baker
(74) *Attorney, Agent, or Firm* — Foley & Lardner LLP

(57) ABSTRACT

A shower sealing system includes a sliding shower door slidable along a length of an upper track assembly and configured to slide horizontally and freely above a surface and a sealing element configured to provide a fluid seal between the surface and at least a portion of the shower door. The system also includes a trigger mechanism coupled to the sealing element and a stop configured to activate the trigger mechanism when at least partially in contact with the trigger mechanism. The trigger mechanism is configured to move the sealing element from a storage position to a sealing position when the stop activates the trigger mechanism. The sealing element provides a fluid seal between the shower door and the surface when the sealing element is in the sealing position.

20 Claims, 6 Drawing Sheets

(56) References Cited

U.S. PATENT DOCUMENTS

| | | | |
|---|---|---|---|
| 6,125,584 | A | 10/2000 | Sanders |
| 6,195,939 | B1 | 3/2001 | Sowers |
| 7,028,740 | B2 | 4/2006 | Clarady et al. |
| 7,124,538 | B1 | 10/2006 | Kline |
| 8,381,445 | B2 | 2/2013 | Hans |
| 2002/0092628 | A1 | 7/2002 | Todd |

FOREIGN PATENT DOCUMENTS

| | | | |
|---|---|---|---|
| WO | WO2011/110548 | 9/2011 | |
| WO | WO2011110548 A1 * | 9/2011 | ..... A47K 3/32 |

OTHER PUBLICATIONS

European Search Report in Application No. 14160144.3; 6 pages.

* cited by examiner

SHOWER DOOR SEAL SYSTEM

CROSS REFERENCE TO RELATED PATENT APPLICATIONS

The present application claims the benefit of and priority to U.S. Provisional Application No. 61/793,434, filed Mar. 15, 2013, the entire disclosure of which is incorporated herein by reference.

BACKGROUND

The present application relates to sliding shower doors, and more particularly, to a sealing system for a sliding shower door.

Shower doors may be slidably attached to a shower door track. Conventional shower doors typically slide between an open and a closed position, sliding to the open position in order to allow a bather to enter the shower and sliding to the closed position when the shower is in use. The shower doors are often coupled to the shower and fitted against the sides of a shower opening in order to prevent a liquid (e.g. water) from leaking out of the shower and onto the ground. However, shower doors are subject to wear from frequent use as the shower door slides between the open and closed positions. Also, shower doors are typically made from a metal and are not configured to form a fluid seal with a surface. As a result, the shower doors may not form a watertight seal with the shower, and water may leak from the shower when the shower is in use.

SUMMARY

An embodiment of the present disclosure relates to a shower sealing system. The shower sealing system may include a sliding shower door slidable along a length of an upper track assembly and configured to slide horizontally and freely above a surface and a sealing element configured to provide a fluid seal between the surface and at least a portion of the shower door. The system may also include a trigger mechanism coupled to the sealing element and a stop configured to activate the trigger mechanism when at least partially in contact with the trigger mechanism. The trigger mechanism can be configured to move the sealing element from a storage position to a sealing position when the stop activates the trigger mechanism. The sealing element may provide a fluid seal between the shower door and the surface when the sealing element is in the sealing position.

Another embodiment of the present disclosure relates to a movable shower door that is slidingly movable relative to a surface. The movable shower door may include a sealing element configured to provide a fluid seal between a surface and at least a portion of the shower door and a trigger mechanism coupled to the sealing element and configured to move the sealing element. The sealing element can be movable between a sealing position where the shower door and the surface are fluidly sealed and a storage position where the shower door is configured to slide freely above the surface. The trigger mechanism can be configured to be activated upon contact to a stop to move the sealing element from the storage position to the sealing position.

Another embodiment of the present disclosure relates to a method of sealing a shower door. The method may comprise sliding the shower door along a surface toward a closed position, wherein a bottom surface of the door can be above the surface and the door can be configured to slide freely above the surface. The method may also comprise contacting a trigger mechanism and a stop to activate the trigger mechanism to cause a sealing element to extend from a storage position to a sealing position to creates a fluid seal between the shower door and the surface, wherein a watertight seal between the sealing element and the surface can be formed in the sealing position.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION OF THE PREFERRED EMBODIMENTS

Referring to the FIGURES generally, various embodiments disclosed herein relate to a seal system for a sliding shower door. The shower door seal system is positioned to provide a fluid seal between the shower door and a surface such as the top surface of a tub. The shower door seal system is retractable such that the shower door is able to slide freely between an open and closed position when the fluid seal is not engaged.

Figure 1:
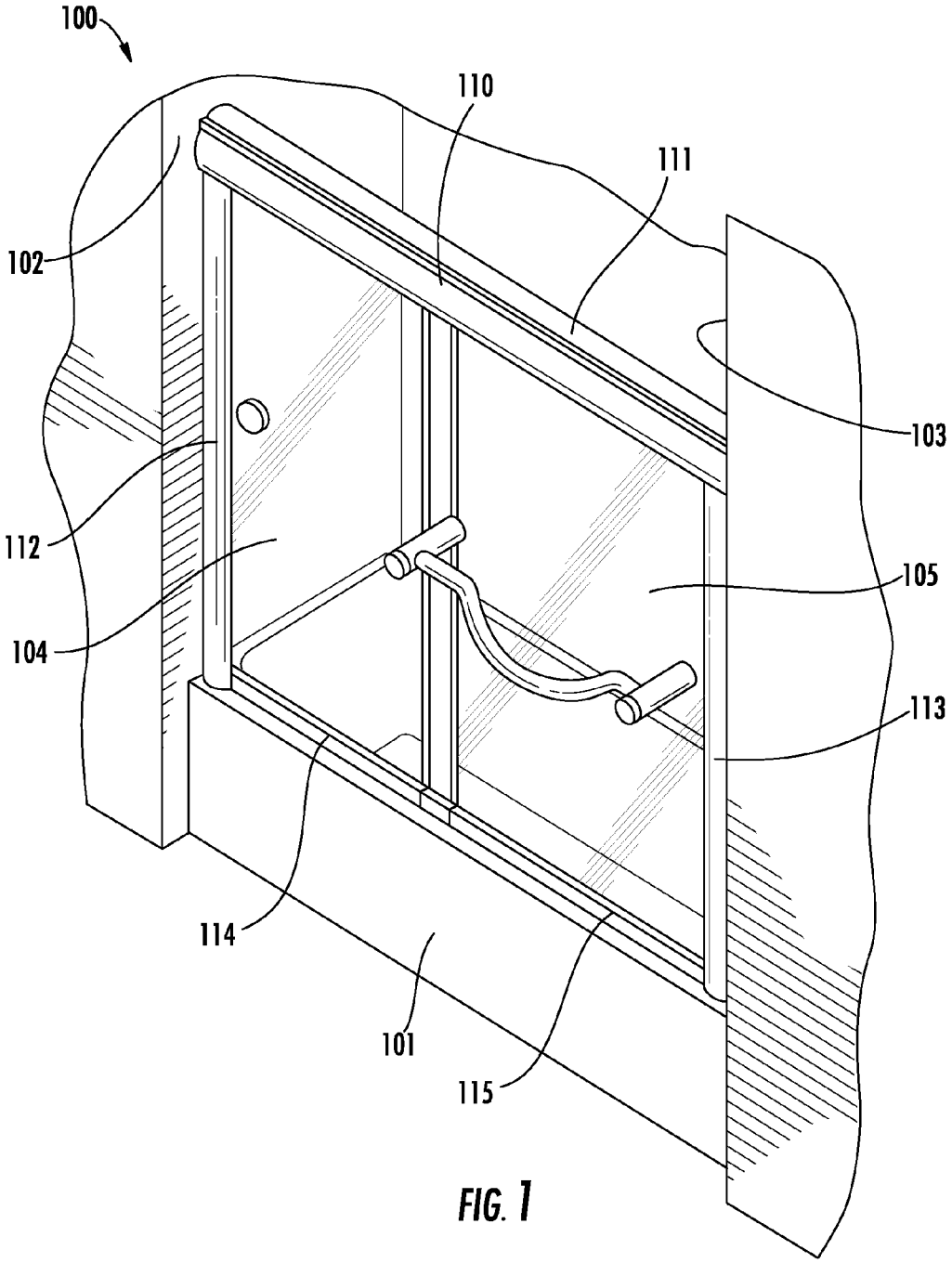
FIG. 1 is a view of a shower having sliding doors, according to an exemplary embodiment.

Referring to FIG. 1, shower 100 is shown according to an exemplary embodiment. The shower 100 includes a tub 101, which is positioned between a first wall 102 and a second wall 103. Access to the shower 100 is closed off by sliding shower doors 104 and 105. The shower doors 104 and 105 slide along the length of an upper track assembly 111. The upper track assembly 111 may be connected to walls 102 and 103 and/or supported by wall jambs 112 and 113. The sliding motion of the shower doors 104 and 105 is limited by the wall jambs 112 and 113. In an exemplary embodiment, the shower door 104 and the shower door 105 can slide in either direction past one another along the upper track assembly 111 to create a passageway adjacent either side wall 102 or 103 through which a bather enters and exits the shower 100.

In some embodiments, the upper track assembly 111 includes tracks (not shown) for mating with the shower doors 104 and 105. In these embodiments, the shower doors 104 and 105 may include rollers or wheels (not shown) that couple to the tracks, rolling within the tracks to allow the shower doors 104 and 105 to slide between an open and a closed position. In some other embodiments, the upper track assembly 111 may include track subassembly 213 (shown in FIG. 2) coupled to the shower doors 104 and 105 for sliding the doors 104 and/or 105 between an open and a closed position. The track subassembly 213 is shown in further detail in FIG. 2, according to an exemplary embodiment. The upper track assembly 111 may include an upper track cover 110 for protecting tracks from typical wear and for covering tracks from view.

The shower doors 104 and 105 also include rails 114 and 115 positioned along a bottom edge of the shower doors 104 and 105, respectively. The rails 114 and 115 are sized and shaped to form a bottom frame for the shower doors 104 and 105, respectively. The rails 114 and 115 may protect the outer edges of the shower doors 104 and 105 from regular wear, and may also maintain the structural integrity of the shower doors 104 and 105. The rails 114 and 115 may each include a sealing element 208 (shown in FIGS. 3-6) for providing a fluid seal at the bottom of the shower 100. The sealing element 208 may be retractable and configured to extend when the shower doors 104 and/or 105 are in the closed position, and to retract when the shower doors 104 and/or 105 move away from the closed position. The sealing element is shown in further detail in FIGS. 3-6.

Figure 2:
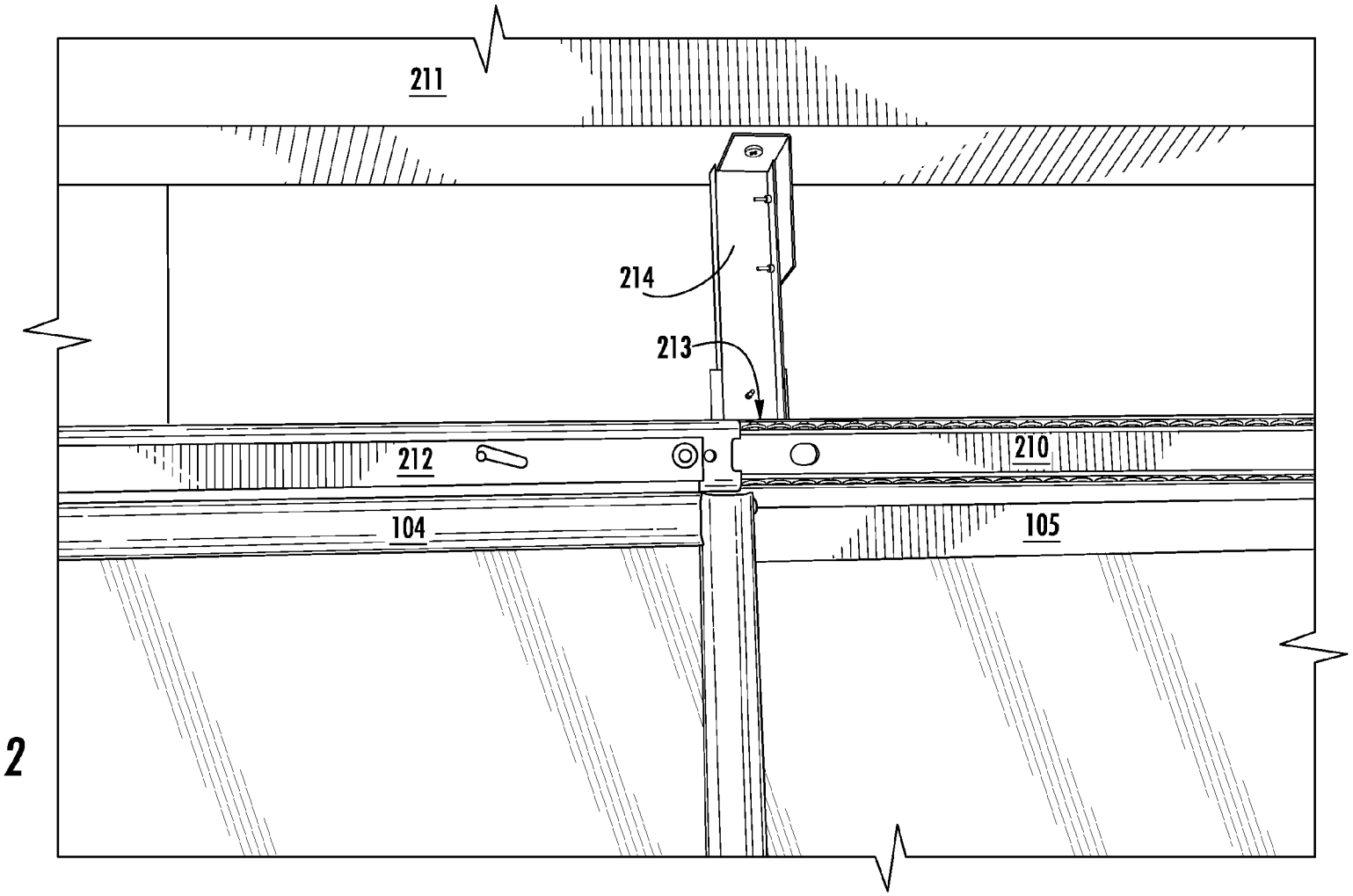
FIG. 2 is a close-up view of a rail subassembly for shower doors, according to an exemplary embodiment.

Referring now to FIG. 2, the track subassembly 213 is shown, according to an exemplary embodiment. In this embodiment, the upper track cover 110 is removed from the upper track assembly 111 in order to provide a view of the track subassembly 213. The track subassembly 213 includes a track base 210 coupled to the shower door 105 and a telescoping rail 212 coupled to the shower door 104 (e.g., the track subassembly may have a telescoping configuration similar to those used on some types of pull-out drawers in kitchen cabinetry). The telescoping rail 212 is shaped to receive the track base 210, and is coupled to the track base 210 in the illustrated embodiment of FIG. 2. In this embodiment, the shower door 105 is configured to remain static and in the closed position of FIG. 2. The shower door 104 is configured to slide relative to the shower door 105 to an open position by sliding the telescoping rail 212 over the track base 210 such that the track base 210 is entirely disposed within the telescoping rail 212. The shower door 104 is configured to slide into a closed position (shown in FIG. 2) by sliding the telescoping rail 212 horizontally away from the track base 210 such that the telescoping rail 212 extends to the first wall 102. The track subassembly 213 may be coupled to a ceiling 211 of the shower 100 by a bracket 214. The track subassembly 213 may also be coupled to the first wall 102 and/or the second wall 103 so that the track subassembly 213 is rigid relative to the shower 100. The upper track cover 110 is configured to fit over the track subassembly 213 in order to cover the track subassembly 213 from view and protect its components.

Figure 3:
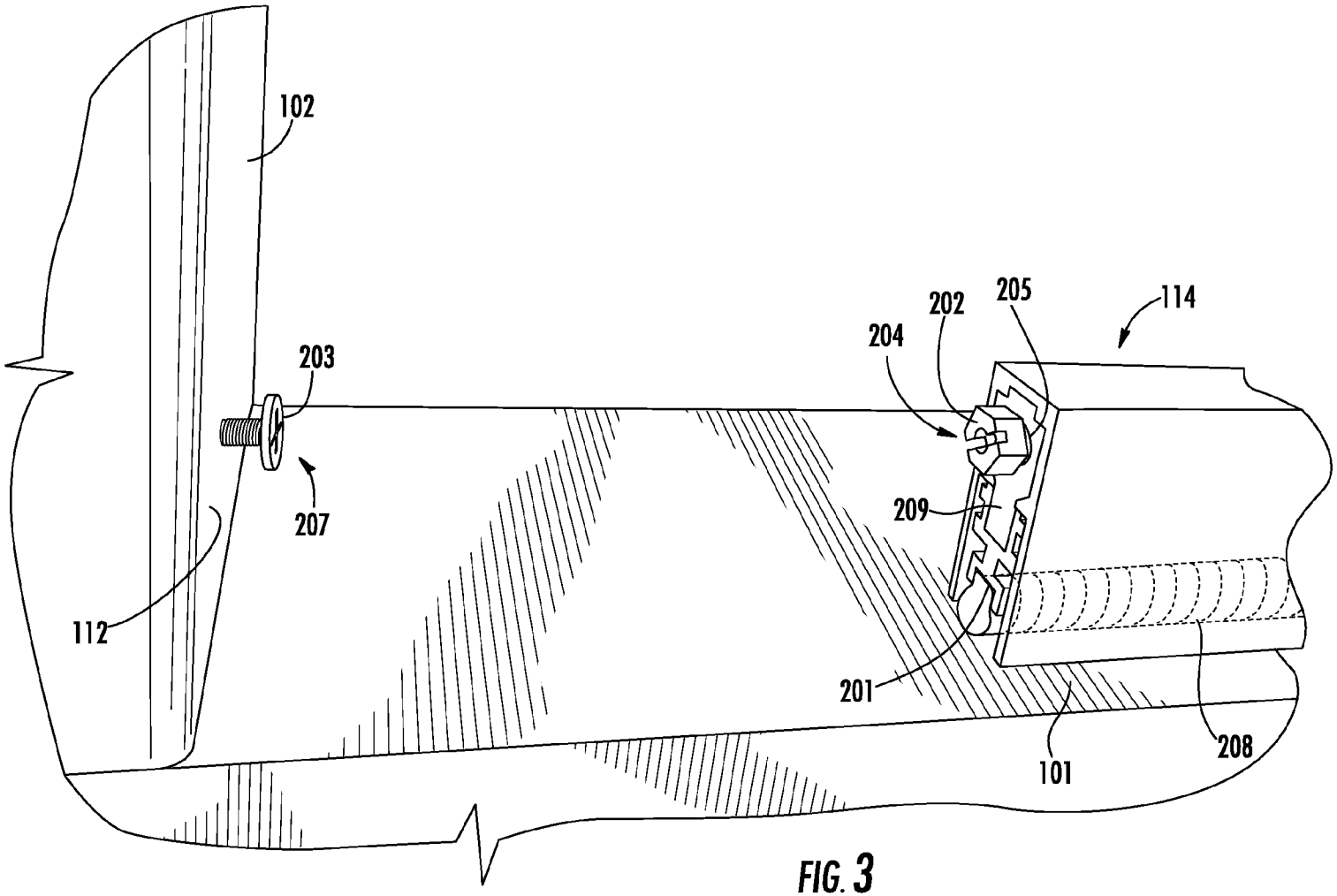
FIG. 3 is a perspective view of a shower door in an open position and a sealing system in a retracted position within the door, according to an exemplary embodiment.
Figure 4:
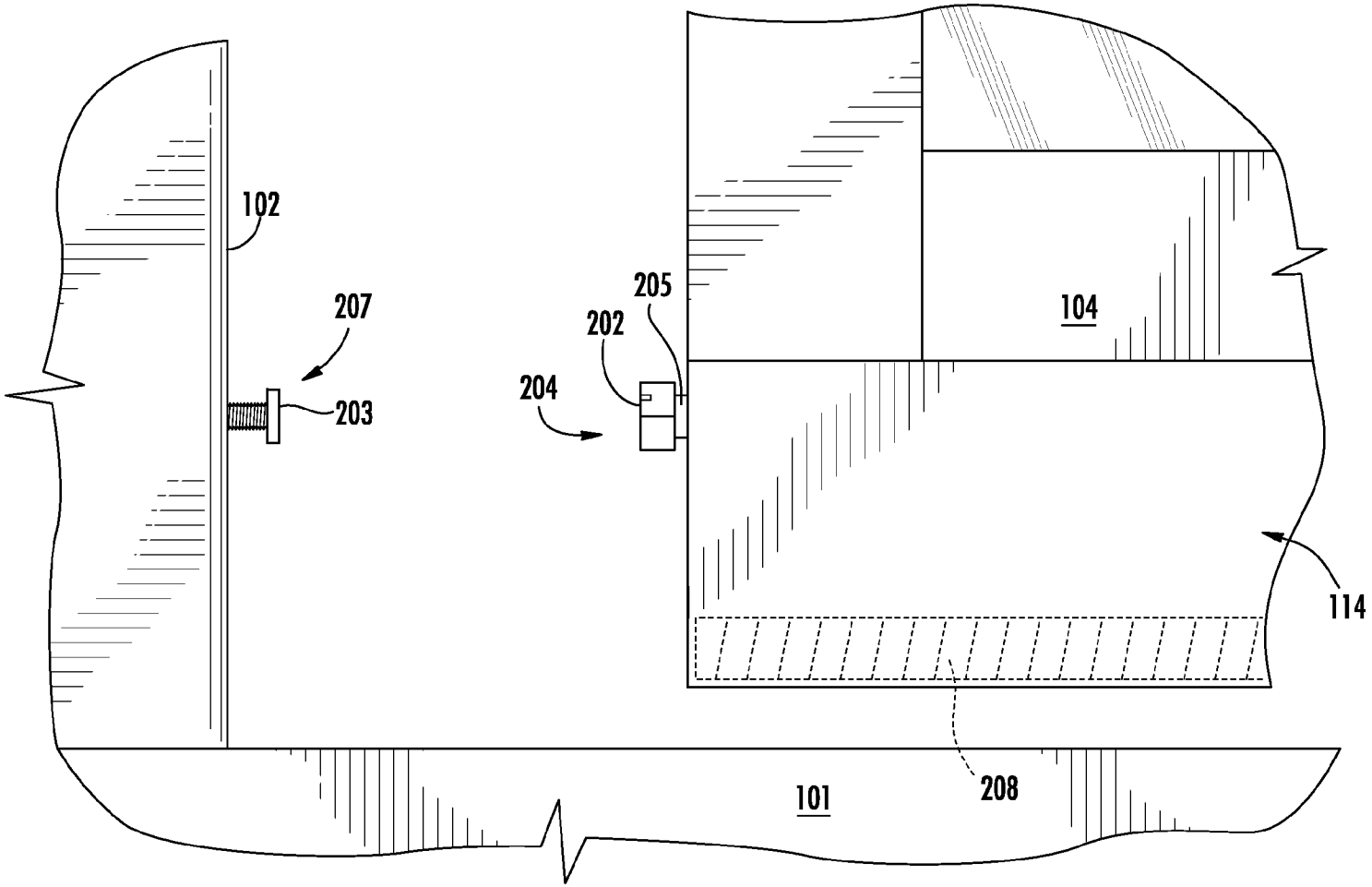
FIG. 4 is a side view of the shower door and sealing system of FIG. 2, with the shower door in the open position and the sealing system in the retracted position, according to an exemplary embodiment.

Referring now to FIGS. 3 through 6, a rail 114 for a shower door 104 is shown according to an exemplary embodiment. The rail 114 is shown independently of the shower door 104 in FIGS. 3 through 6, but is configured to couple to a bottom edge of the shower door 104 (shown in FIG. 1) in exemplary embodiments. The shower door 105 may also include rail 115. The rail 115 is similar to rail 114 but is coupled to the bottom of the shower door 105. The rail 114 may protect the bottom edge of the shower door 104 from typical wear, and may also maintain the structure of shower door 104 by providing a frame. The shower door 104 is shown in FIGS. 3 and 4 in an open position, resting a distance away from the first wall 102. When the shower door 104 is in the open position (as shown in FIG. 3), the rail 114 rests a distance away from a surface of the tub 101 so that the shower door 104 is able to slide freely between the open position and the closed position (shown in FIG. 6) without the bottom of the rail 114 contacting the tub 101. In other embodiments, the rail 114 may be fitted within a U-shaped guide (not shown) and resting a distance above the surface of the U-shaped guide. The top and two sides of the rail 114 are covered in order to protect any components within the rail 114. The bottom of the rail 114 is left open so that a sealing element 108 may be provided to maintain a watertight seal between the shower door 104 and the tub 101 (or another surface).

In an exemplary embodiment, the rail 114 includes a retractable sealing element 208. The retractable sealing element 208 may be a rubber seal or may be made from another material suitable for providing a watertight seal between the rail 114 and a surface (e.g. tub 101, a floor, a shower ledge, etc.). The sealing element 208 extends the length of the rail 114 in order to provide a fluid seal across the shower door 104 when the shower door 104 is in the closed position. The sealing element 208 is shown in a storage (e.g. retracted) position in FIGS. 3 and 4. In the storage position, the sealing element 208 may be entirely disposed within the rail 114, allowing the rail 114 and shower door 104 to slide freely between the open and closed positions a distance above the tub 101. The sealing element 208 remains in the storage position as the shower door 104 is moved so that the sealing element 208 does not interfere with the surface of the tub 101 or cause friction, potentially damaging the shower door 104 or the sealing element 208. When the sealing element 208 is in the storage position, the shower door 104 slides along a single horizontal axis between the open and closed positions.

In an exemplary embodiment, a trigger mechanism 204 is coupled to the sealing element 208. In this embodiment, the sealing element 208 is moved from the storage position to an extended position (shown in FIG. 6) by movement of the trigger mechanism 204. In the illustrated embodiments of FIGS. 3 through 6, the trigger mechanism 204 is a protruding knob (e.g. bump, button, etc.) that is actuated by applying a horizontal force into the trigger mechanism 204. However, in other embodiments the trigger mechanism 204 may be a switch, toggle, lever, or any other device suitable for causing the sealing element 208 to move between a storage and an extended position. The sealing element 208 remains in the storage position until a force is applied to the trigger mechanism 204, moving the trigger mechanism 204 horizontally (according to FIGS. 4 through 6) and into the rail 114. The sealing element 208 may be coupled to the trigger mechanism 204 by a bracket 201. In these embodiments, when a force is applied to the trigger mechanism 204, the trigger mechanism 204 may cause the bracket 201 to move the sealing element 208 into an extended position. The bracket 201 may be made from metal or another rigid material configured to drive the sealing element 208 from the rail 114.

In some embodiments, the sealing element 208 moves discretely between the storage position and the extended position. In these embodiments, the sealing element 208 moves to the extended position when the trigger mechanism 204 is triggered or actuated. The trigger mechanism 204 may be actuated when the trigger mechanism 204 is pushed completely into an opening 209 of the rail 114. Once actuated, the trigger mechanism 204 causes the sealing element 208 to extend from the bottom of the rail 114 to the extended position (shown in FIG. 6), providing a watertight seal between the rail 114 and the surface of the tub 101, or between the rail 114 and another surface such as a floor or a ledge. Once the trigger mechanism 204 is no longer actuated, the sealing element 208 returns to the storage position.

In other embodiments, the sealing element 208 moves continuously between the storage position and the extended position. In these embodiments, the position of the sealing element 208 is linearly related to the trigger mechanism 204, such that the sealing element 208 extends out from the bottom of the shower door 104 a distance corresponding to the distance that the trigger mechanism 204 is forced within the rail 114. For instance, in FIG. 5 a force is applied to the trigger mechanism 204 and the sealing element 208 is partially extended from the shower door 104. The distance the sealing element 208 is extended from the shower door is relative to the position of the trigger mechanism 204. When a force is not applied to the trigger mechanism 204, the sealing element 208 returns to the storage position.

Figure 5:
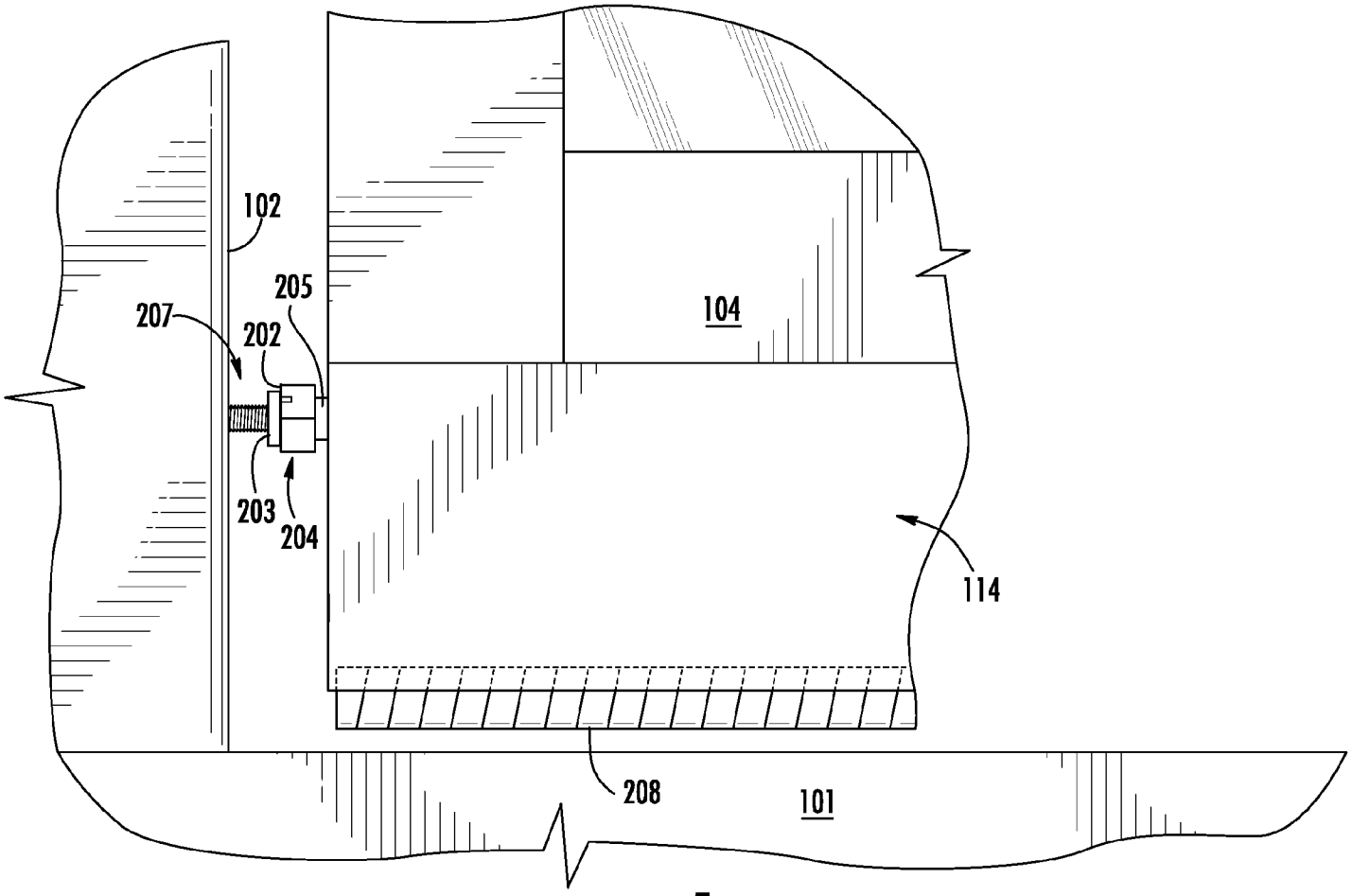
FIG. 5 is a side view of the shower door and sealing system of FIG. 2, with the shower door in a partially open position and the sealing system in a partially extended position, according to an exemplary embodiment.

According to the illustrated embodiment of FIGS. 3 through 6, the trigger mechanism 204 includes a flat face 202 for interacting with stop 207. The stop 207 is rigidly coupled to the first wall 102. The stop 207 is shown to have a screw or bolt shape in FIGS. 3 through 6, but the stop 207 may have another shape suitable for actuating the trigger mechanism 204 in other embodiments. The stop 207 is positioned in order to align with the triggering mechanism 204, such that the flat face 203 of the stop 207 contacts the flat face 202 of the trigger mechanism 204 (as shown in FIG. 5) when the door 104 is moved to a closed position. The wall jamb 112 is partially removed in FIGS. 3 through 6 in order to more clearly show the stop 207, but in an exemplary embodiment the wall jamb 112 may hide the stop 207 from view, providing a more aesthetically-pleasing view. The trigger mechanism 204 includes a rod 205 coupled to the flat face 202 and protruding into the opening 209 of the rail 114. When the trigger mechanism 204 is in the non-actuated position of FIGS. 3 and 4, the rod 205 is fully extended, causing the face 202 to extend out from an opening 209 within the rail 114.

Referring now to FIG. 5, the rail 114 is engaged with the stop 207. As the rail 114 moves to the closed position (shown in FIG. 6), the face 203 of the stop 207 contacts the face 202 of the trigger mechanism 204. The stop 207 is rigidly coupled to the first wall 102 such that the stop 207 remains static when contacted by the trigger mechanism 204. The trigger mechanism 204 is pushed in the horizontal direction by the rigid stop 207, pushing the face 202 and the rod 205 of the trigger mechanism 204 into the rail 114. When engaged as shown in FIG. 5, the trigger mechanism 204 causes the sealing element 208 to extend out from the rail 114 in order to form a watertight seal with the surface of the tub 101. In the illustrated embodiment of FIG. 5, the sealing element 208 is shown in a partially extended position corresponding with the position of the trigger mechanism 204. The sealing element 208 may extend to a fully extended position (shown in FIG. 6) as the trigger mechanism 204 is forced further into the rail 114 by the stop 207.

Figure 6:
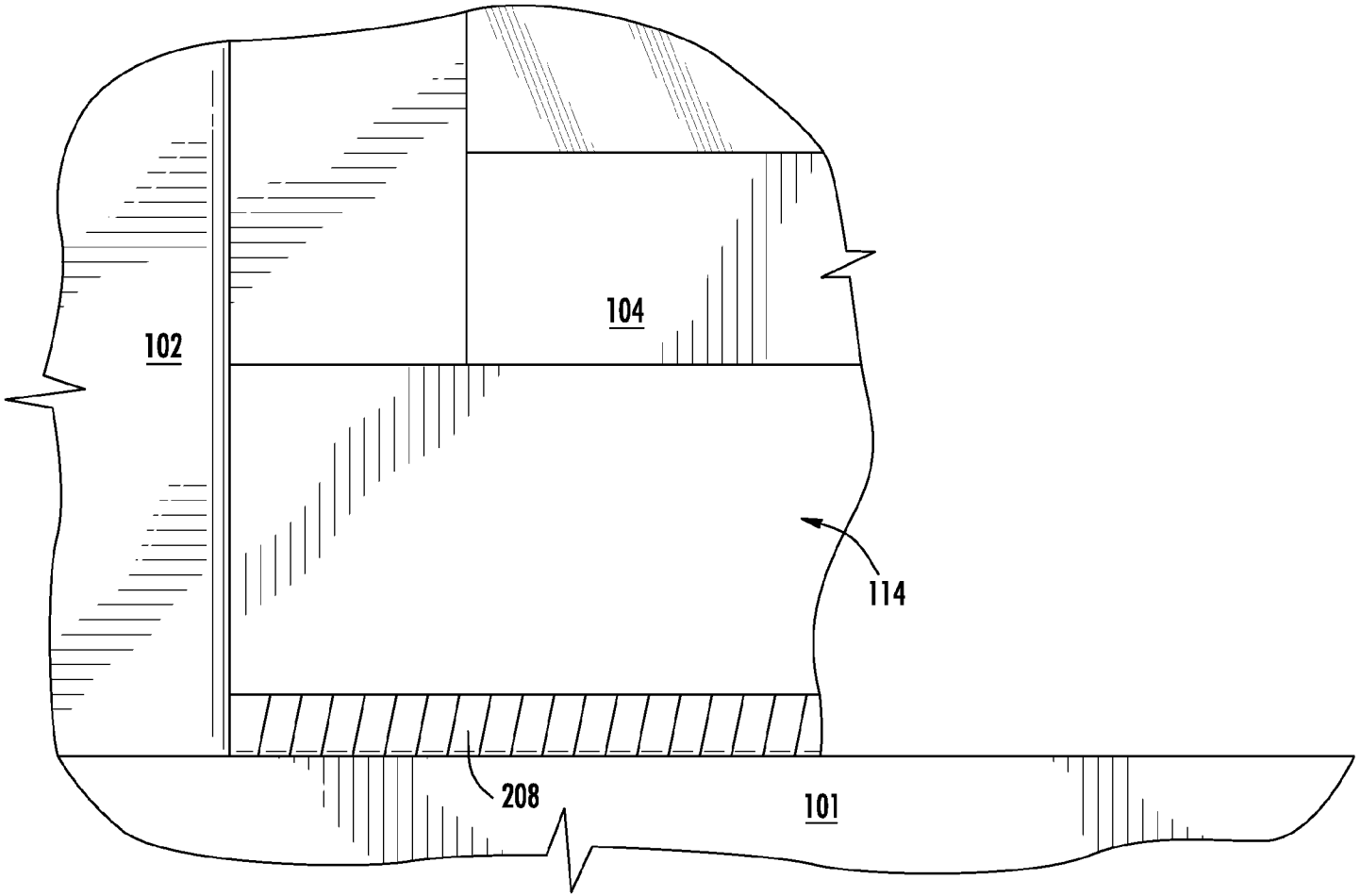
FIG. 6 is a side view of the shower door and sealing system of FIG. 2, with the shower door in a closed position and the sealing system in an extended position, according to an exemplary embodiment.

Referring now to FIG. 6, the shower door 104 is shown in the closed position, according to an exemplary embodiment. In this embodiment, the stop 207 is engaged with the trigger mechanism 204, forcing the trigger mechanism 204 completely within the rail 114 and actuating the trigger mechanism 204. When the trigger mechanism 204 is actuated, the trigger mechanism 204 causes the sealing element 208 to move to the extended position, forming a fluid seal between the shower door 104 and the surface of the tub 101. When the shower door 104 is in the closed position, the trigger mechanism 204 and the stop 207 are received within the opening 209 of the rail 114 so that the shower door 104 is pressed against the first wall 102.

The sealing element 208 is configured to fluidly seal the shower door 104 at the surface of the tub 101 when in the extended sealing position. In other embodiments, the sealing element 208 may form a fluid seal with another surface suitable for the application. In the storage position, the sealing element 208 is retracted within the shower door 104 so that the shower door 104 is allowed to freely slide a distance above a surface, preventing damage to the shower door 104 or the sealing element 208. In the storage position, the sealing element 208 is protected from wear typically caused by sliding the shower door 104 along a surface. The sealing element 208 is moved to the extended position once the shower door 104 is closed and a fluid seal is desired. The sealing element 208 may be utilized to provide a watertight seal for shower doors 104 and 105, or another shower door slidably coupled to a track assembly.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A shower sealing system, comprising:

a sliding shower door slidable along a length of an upper track assembly and configured to slide horizontally and freely above a surface;

a sealing element configured to provide a fluid seal between the surface and at least a portion of the shower door;

a trigger mechanism coupled to the sealing element; and a stop configured to activate the trigger mechanism when at least partially in contact with the trigger mechanism;

wherein the trigger mechanism is configured to move the sealing element from a storage position to a sealing position when the stop activates the trigger mechanism;

wherein the stop is configured to activate the trigger mechanism when the shower door is at least partially closed such that the sealing element is in the sealing position when the shower door is in a closed position; and wherein the sealing element provides the fluid seal between the shower door and the surface when the sealing element is in the sealing position.

2. The shower sealing system of claim 1, wherein the sealing element is retractable within and extendable from the shower door.

3. The shower sealing system of claim 1, wherein the sealing element is retracted into the storage position when the shower door is not in the closed position.

4. The shower sealing system of claim 1, wherein the sealing element remains in the storage position until a force is applied to the trigger mechanism and returns to the storage position when a force is not applied to the trigger mechanism.

5. The shower sealing system of claim 1, wherein the sealing element extends the length of a bottom edge of the shower door.

6. The shower sealing system of claim 1, wherein the trigger mechanism is at least partially extended relative to the shower door to engage with the stop when the sealing element is in the storage position.

7. The shower sealing system of claim 1, wherein the sealing element is at least partially retracted within the shower door in the storage position such that the shower door is slidable a distance above the surface.

8. The shower sealing system of claim 1, wherein the stop is rigidly coupled to a wall and the sealing element is coupled to the shower door.

9. The shower sealing system of claim 1, wherein the upper track assembly comprises a telescoping rail coupled to the shower door.

10. The shower sealing system of claim 1, wherein the shower door includes rollers to allow the shower doors to slide between an open position and the closed position.

11. The shower sealing system of claim 1, wherein a position of the sealing element is linearly related to a position of the trigger mechanism.

12. A movable shower door that is slidingly movable relative to a surface, the movable shower door comprising:

a sealing element configured to provide a fluid seal between a surface and at least a portion of the shower door; and a trigger mechanism coupled to the sealing element and configured to move the sealing element;

wherein the sealing element is movable between a sealing position where the shower door and the surface are fluidly sealed and a storage position where the shower door is configured to slide freely above the surface;

wherein the trigger mechanism is configured to be activated upon contact to a stop such that the trigger mechanism moves the sealing element from the storage position to the sealing position;

wherein at least partially closing the shower door activates the trigger mechanism with the stop such that the sealing element is in the sealing position when the shower door is in a closed position.

13. The movable shower door of claim 12, wherein the sealing element retracts into the storage position when the shower door is not in the closed position.

14. The movable shower door of claim 12, wherein the sealing element is coupled to and retractable within the shower door.

15. A method of sealing a shower door, comprising:

sliding the shower door along a surface toward a closed position, wherein a bottom surface of the door is above the surface and the door is configured to slide freely above the surface; and contacting a trigger mechanism and a stop when the shower door is at least partially closed to activate the trigger mechanism to cause a sealing element to extend from a storage position to a sealing position to create a fluid seal between the shower door and the surface such that the sealing element is in the sealing position when the shower door is in the closed position;

wherein a watertight seal between the sealing element and the surface is formed in the sealing position.

16. The method according to claim 15, further comprising retracting the sealing element into the storage position when the shower door is not in the closed position.

17. The method according to claim 16, wherein the shower door is freely slidable above the surface when the sealing element is in the storage position.

18. The method according to claim 15, further comprising moving the trigger mechanism with the stop to extend the sealing element.

19. The method according to claim 15, wherein the sealing element retracts into the storage position when the shower door is not in the closed position.

20. The shower sealing system of claim 1, wherein the trigger mechanism is pushed completely into an opening within the shower door when the sealing element is in the sealing position and does not extend completely into the opening when the sealing element is in the storage position.

* * * * *